United States Patent [19]

Kawata

[11] 4,422,750

[45] Dec. 27, 1983

[54] DEVELOPER REPLENISHING DEVICE

[75] Inventor: Shun Kawata, Hachioji, Japan

[73] Assignee: Konishiroku Photo Industry Co., Ltd., Tokyo, Japan

[21] Appl. No.: 355,463

[22] Filed: Mar. 8, 1982

[30] Foreign Application Priority Data

Mar. 25, 1981 [JP] Japan ..... 56-42455[U]

[51] Int. Cl.[3] ..... G03G 15/08

[52] U.S. Cl. ..... 355/3 DD; 355/14 D; 118/657

[58] Field of Search ..... 355/3 DD, 14 D, 15, 355/16; 118/657, 658; 430/122

[56] References Cited

U.S. PATENT DOCUMENTS

| | | | |
|---|---|---|---|
| 3,879,124 | 4/1975 | Eppe et al. | 355/15 |
| 4,021,108 | 5/1977 | Ozaki et al. | 355/3 R |
| 4,155,652 | 5/1979 | Buchan et al. | 355/3 DD X |
| 4,194,465 | 3/1980 | Tsukamoto et al. | 355/3 DD X |
| 4,227,796 | 10/1980 | Kamp et al. | 355/3 DD |
| 4,266,868 | 5/1981 | Bresina et al. | 355/3 DD |
| 4,286,544 | 9/1981 | Witte | 355/3 DD X |
| 4,328,762 | 5/1982 | Wada | 355/3 DD X |
| 4,339,196 | 7/1982 | Beck et al. | 355/14 D X |

*Primary Examiner*—A. C. Prescott

*Attorney, Agent, or Firm*—Jordan B. Bierman; Linda Bierman; C. Cornell Remsen, Jr.

[57] ABSTRACT

In an image recording apparatus means such as a spiral screw are provided for feeding toner from a supply hopper to an image developing unit. A plate is mounted within said bin for oscillating movement caused by extensions on said plate engaging the spiral surface of the feeding screw. The plate may be formed with stirring blades, a shaker plate and suitable openings therethrough for continuously agitating the toner as it is being fed to brake up clumps which may be formed and to prevent toner caking.

7 Claims, 5 Drawing Figures

DEVELOPER REPLENISHING DEVICE

BACKGROUND OF THE INVENTION

1. Field of the Invention

The present invention relates to the improvement of a developer replenishing device that replenishes developer in proper quantity from the developer container to the developing unit attached to an image recording apparatus, and more particularly to the stirring means for the developer in the container or hopper of said developer replenishing device.

2. Description of the Prior Art

A developer to be used for image recording is prepared by mixing pigment or dye such as carbon black and other material with resins adapted to the mode of the image recording apparatus, or with magnetic substances such as iron powder depending upon said mode. It is a defect of the developer used for the dry development that it may become impossible to replenish the developer in the developing unit, by reason of the fact that by the adhesion of an active substance remaining on each fine grain developer, transmutation and transformation of each fine grain of the developer, or the influence of moisture, bridging or junction takes place between fine grains of the developer, and they gradually become lumps of grains. Another drawback is that a black spot appears on the image when a lump of grains drops into the developing unit and keeps its form.

It has been previously proposed that a stirrer having a special driving source is provided in the developer container in order to prevent the developer from becoming a lump of grains when it is left alone, but this is contrary to the desires of cost reduction, compactness and simplicity. There is an example in which a stirring disk having stirring claws that couple with a transporting member carrying the developer from the developer container to the developing section of the developing unit is arranged inside said developer container. However, circular stirring within the developer container surrounded by flat plates causes dead spaces where stirring can not reach and a stirring claw gives a checking effect to the toner in the form of the cylindrical chip laid on said stirring disk being divided by a stirring claw, thereby the stirring effect is insufficient and it is feared that the tendency to become a lump of grains from powder increases.

SUMMARY OF THE INVENTION

An object of the present invention is to offer a developer replenishing device wherein caking of the toner can be prevented simply, economically and sufficiently.

The object of the present invention can be attained by a developer replenishing device for replenishing the developer in proper quantity from a developer container to a developing unit, which device comprises a transporting member for carrying said developer to said developing unit, and an oscillating or swinging member coupled to said transporting member and stirring the developer in the developer container by the action of said swinging member.

In the toner replenishing device of the present invention, at least one sheet of a swinging plate is rotatably mounted on a shaft in parallel with or with proper angle adjacent the side wall of the hopper and followers are provided on said plate in such positions that they can engage the rotational driving portion of a transporter, such as a spiral screw, a belt or a bucket. The rotation of said transporter is converted into the oscillatory motion of the swinging follower by the vertical motion of the spiral surface or, an eccentric cam and a restoring spring used as an auxiliary means so that the swinging plate swings to give stirring, kneading or rubbing effects derived from the swinging motion and thus the caking of the toner is prevented. In order to give the aforesaid effects, the swinging plate is provided a stirring blade, opening or spatulate plate with most effective size and number and position, considering the direction of swinging and the width of swinging. On the edge of the swinging plate, it is possible to provide a shaking plate that shakes the toner into the space between the side wall of the developer container and the swinging plate or the space between the swinging plates.

The stirring blade is to stir the toner by the swinging thereof and the opening is to promote passing of the toner to both sides of the swinging plate. The spatulate plates roll the lump of grains produced in the toner, destroy them and scrape them up to one side of the swinging plate, utilizing the openings, and mix them evenly. The shaking plate shakes the toner into the gap between the swinging plate and the side wall of the developer container, and promotes the action effect for stirring, kneading or rubbing.

The swinging or oscillating member can be of a type of compound sheet or of a type of a multi sheet without being limited to the type of single sheet.

Further, by providing a swinging diverging plate on each swinging plate, it is possible to cause a swinging in a different direction from said swinging plate itself, and thus further increase the action effect of stirring, kneading or rubbing.

It is possible to make the cleaning of the swinging plate, inside of the developer container and the transporting member convenient when the swinging plate is of a detachable type.

As a material for the swinging plate, it is possible to select from a metal plate, a metal foil-laminated plate or a resin plate, the one that is preferable from the view point of electrostatic ranking in triboelectrification considering the electric polarity to be given to a charge retaining member of the image-recording apparatus and the electric polarity to be given to the developer. When the selection is restricted for the reason of the cost and others, the developer container should be grounded.

DETAILED DESCRIPTION OF THE PREFERRED EMBODIMENTS

Figure 1:
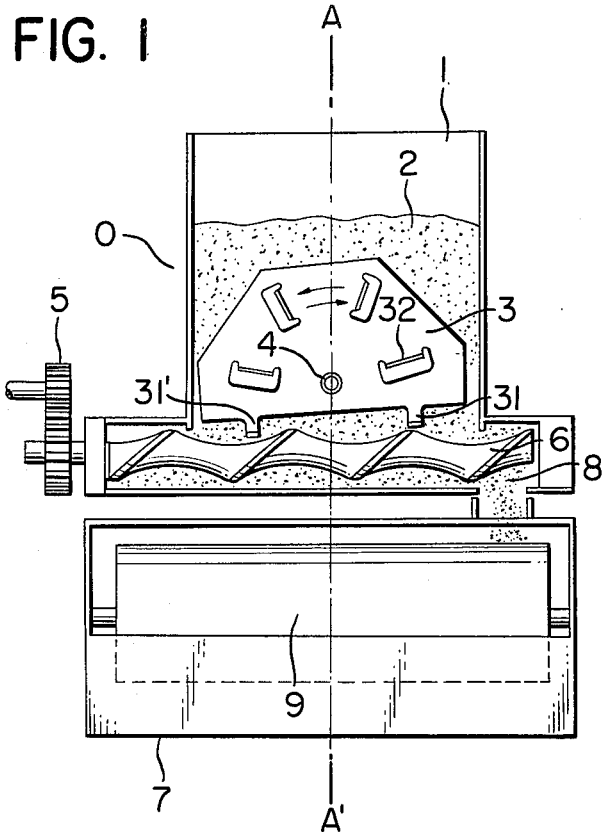
FIG. 1 is a front view of an example of the present invention.

FIG. 1 is an example of the present invention. The example is a swinging plate in the form of single sheet, and the transporter and the swinging plate in parallel. A spiral screw is used as a transporting member, thus two swinging followers are provided on said swinging plate and it is so constructed that one swinging follower the lowest position of said screw while the other contacts the highest position when the swinging plate is placed about the swinging shaft and positioned on the side wall of the developer container.

In FIG. 1, numeral 0 is a developer replenishing device, numeral 1 is a developer container and numeral 2 indicates a developer. Numeral 3 is a swinging or oscillating plate that rotates about shaft 4. The numerals 31 and 31' represent the swinging followers and 32 are stirring blades.

When a driving gear 5 is driven in response to a signal for developer replenishing, spiral screw 6 of the transporting member rotates and feeds out the developer 2 to a toner inlet 8 of the developing unit 7, and thus the developer is replenished upon developing sleeve or drum 9.

The swinging followers 31 and 31' of the swinging plate 3 forcibly engaged with the spiral surface of the spiral screw 6. The swinging plate 3 rotating on shaft 4 and coupling with the rotation of the spiral screw 6 and thereby actuates the stirring blades 32 to stir the developer 2.

Figure 2:
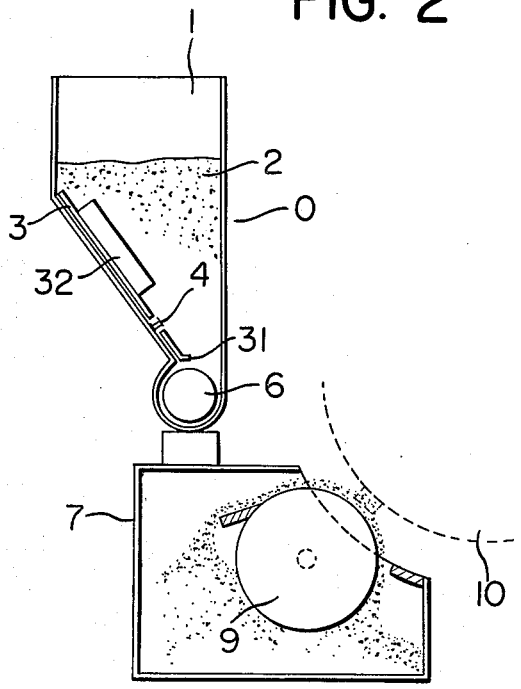
FIG. 2 is a sectional side view thereof taken along the line A—A of FIG. 1.

FIG. 2 shows a sectional view taken along the line A—A' of FIG. 1 and same symbols used in FIG. 1 are used for the same objects. The numeral 10 is a photosensitive substance.

When the spiral screw 6 is not in parallel with the swinging plate 3 as in FIG. 1, there is only one swinging follower and it should be pressed against the spiral surface with the use of a spring, or an eccentric cam coupling with the shaft of spiral screw can be provided with the swinging follower pressed against the circumferential surface of the eccentric cam by a spring, or a groove can be concentrically formed on the circumferential surface of the eccentric cam and the swinging follower inserted therein. If the transporting member is of the type of a belt or bucket, or further even when the transporting direction is not in parallel with a swinging plate, it is still possible to cause the swinging plate to swing using an eccentric cam.

Figure 3:
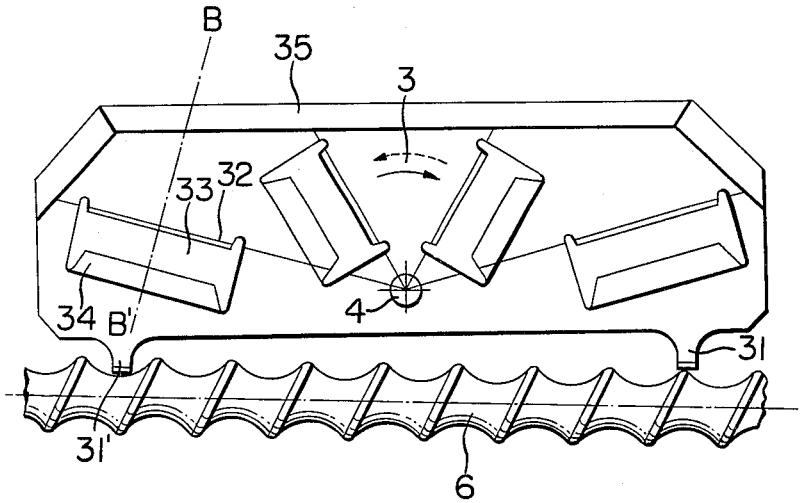
FIG. 3 and FIG. 4 are a front view and a sectional view of the swinging plate respectively.
Figure 4:
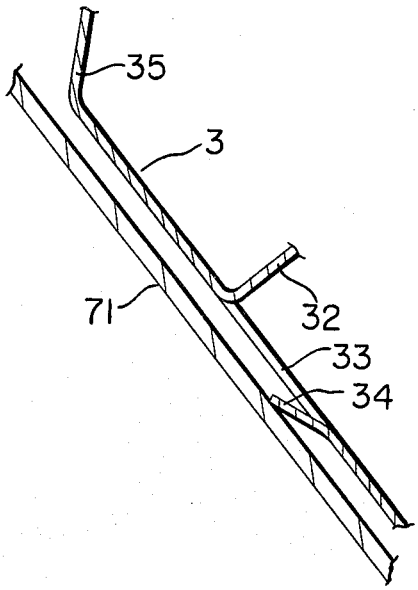

FIG. 3 and FIG. 4 are enlarged view of a modified form of swinging plate 3. The numeral 3 is a swinging plate, 4 is a swinging shaft and 6 is a spiral screw. The numerals 31 and 31' are swinging followers.

A sectional view taken along the line B—B' of FIG. 3 is shown in FIG. 4. Commonly in both drawings, 32 is a stirring blade, 33 is an opening, 34 is a spatulate plate and 35 is a shaking plate provided on the upper edge of the swinging plate 3.

Numeral 71 in FIG. 4 is a side wall of the developer container.

Figure 5A:
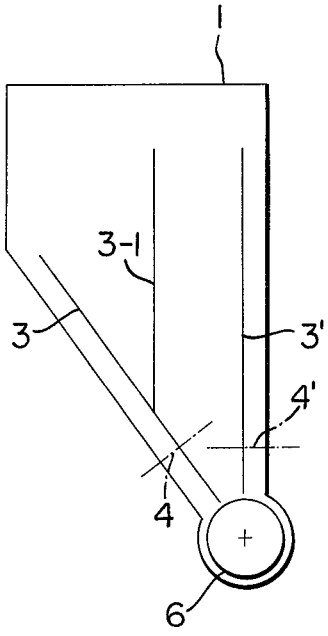
FIG. 5 is a sectional schematic view of an example of the present invention.
Figure 5B:
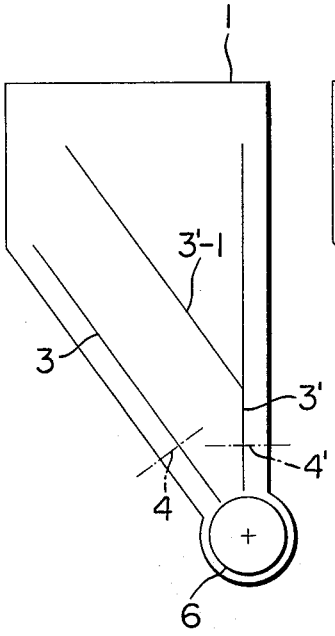
Figure 5C:
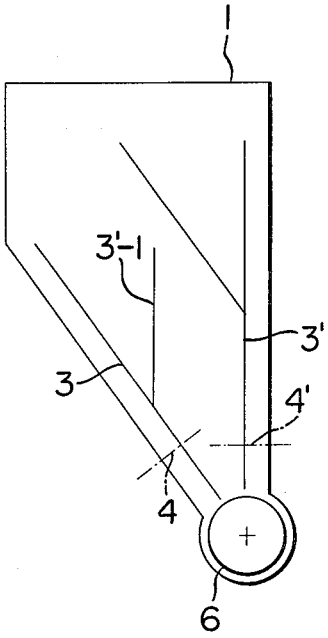

FIG. 5(*a*), (*b*) and (*c*) show schematic sectional views of examples of the developer replenishing device having compounds sheet swinging plates each of which has a swinging diverged plate of the present invention. Commonly in FIG. 5(*a*), (*b*) and (*c*), 3 and 3' are swinging plates, 3-1 and 3'-1 are swinging diverged plates and 4 and 4' are swinging shafts. The numeral 6 shows a spiral screw that is in parallel with a swinging plate. The numeral 1 is a developer container.

What is claimed is:

1. In an image recording apparatus of the type in which means are provided to feed toner from a hopper to an image developing unit, the improvement comprising a plate pivotally mounted within said hopper, and means actuated by said feeding means for oscillating said plate, whereby the oscillating of said plate breaks up clumps of toner which may form within said hopper and coking of the toner is prevented.

2. In an image recording apparatus according to claim 1 in which said feeding means is a spiral screw and in which said plate is formed with a pair of depending followers engaging the surface of said spiral screw to impart oscillating motion to said plate.

3. In an image recording apparatus according to claim 1 or 2 in which said improvement includes one or more outwardly extending stirring blades mounted on said plate.

4. In an image recording apparatus according to claim 2 in which said hopper is formed with one downwardly slanting inner wall leading to said feeding means, and in which said plate is pivotally mounted on the inside of said slanting wall.

5. In an image recording apparatus according to claim 4 in which said improvement includes one or more outwardly extending stirring blades mounted on said plate.

6. In an image recording apparatus according to claim 5 in which said improvement includes means spacing said plate from the slanting inner wall of said hopper, means forming a shaking plate along the upper edge of said oscillating plate and means forming one or more openings through said oscillating plate.

7. In an image recording apparatus according to claim 6 the improvement comprising forming said stirring blades along one edge of said opening, in combination with spatulate blades formed along another edge of each opening and extending outwardly toward the slanting surface of said hopper.

* * * * *